US010758811B2

(12) United States Patent
Smith et al.

(10) Patent No.: US 10,758,811 B2
(45) Date of Patent: Sep. 1, 2020

(54) COLLAPSIBLE SKI HAVING FABRIC HINGE

(71) Applicant: Backcountry Garage, LLC, Ketchum, ID (US)

(72) Inventors: Cory Smith, Ketchum, ID (US); John Kaiser, Ketchum, ID (US)

(73) Assignee: Backcountry Garage, LLC, Ketchum, ID (US)

( * ) Notice: Subject to any disclaimer, the term of this patent is extended or adjusted under 35 U.S.C. 154(b) by 0 days.

(21) Appl. No.: 15/419,626

(22) Filed: Jan. 30, 2017

(65) Prior Publication Data

US 2017/0216709 A1 Aug. 3, 2017

Related U.S. Application Data

(60) Provisional application No. 62/288,390, filed on Jan. 28, 2016.

(51) Int. Cl.
*A63C 5/02* (2006.01)

(52) U.S. Cl.
CPC ..... *A63C 5/02* (2013.01); *A63C 2203/10* (2013.01)

(58) Field of Classification Search
CPC ..... A63C 5/02; A63C 2203/10; F16C 11/10
(Continued)

(56) References Cited

U.S. PATENT DOCUMENTS 1,317,770 A 10/1919 Winter
2,260,057 A 5/1939 Rydberg
(Continued)

FOREIGN PATENT DOCUMENTS

AT 407 610 B 5/2001
DE 2756148 A * 6/1978
(Continued)

OTHER PUBLICATIONS

"Climb Ascent System," publication date unknown, [online], [retrieved on Oct. 5, 2011], retrieved using Internet from <http://www.climb.co.at/en0101.php>.
(Continued)

*Primary Examiner* — Jacob B Meyer
(74) *Attorney, Agent, or Firm* — Venable LLP; Michele V. Frank

(57) ABSTRACT

A collapsible ski device, having: a first forward ski member having a bottom surface, a tip and a rear end; a second middle ski member having a bottom surface, a forward end and a rear end; and a third rear ski member having a bottom surface, a forward end and a tail. The forward end of the second middle ski member is pivotably coupled to the rear end of the first forward ski member by a first hinge mechanism. The first hinge mechanism has a flexible component attached at a first location to a first attachment surface on the first forward ski member and attached at a second location to a second attachment surface on the second middle ski member. The rear end of the second middle ski member is pivotably coupled to the forward end of the third rear ski member by a second hinge mechanism. The second hinge mechanism has a flexible component attached at a first location to a third attachment surface on the second middle ski member and attached at a second location to a fourth attachment surface on the third rear ski member.

17 Claims, 8 Drawing Sheets

(58) Field of Classification Search
USPC ..... 280/603
See application file for complete search history.

(56) References Cited

U.S. PATENT DOCUMENTS

| | | | | | |
|---|---|---|---|---|---|
| 2,241,992 | A | | 5/1941 | Hall | |
| 2,332,404 | A | | 11/1941 | Smith | |
| 2,326,802 | A | | 8/1943 | Robinson et al. | |
| 2,367,528 | A | | 9/1943 | Rollins | |
| 2,791,435 | A | | 5/1957 | Meland | |
| 3,104,888 | A | | 9/1963 | Day et al. | |
| 3,596,918 | A | | 8/1971 | Masuda | |
| 3,689,093 | A | | 9/1972 | Meland | |
| 3,744,811 | A | | 7/1973 | Johnston | |
| 4,125,273 | A | | 11/1978 | Rothmayer | |
| 4,141,570 | A | | 2/1979 | Sudmeier | |
| 4,155,568 | A | | 5/1979 | Galich | |
| 4,161,326 | A | * | 7/1979 | Gaber | A63C 17/01 280/11.208 |
| 4,234,208 | A | | 11/1980 | Anderie | |
| 4,248,449 | A | | 2/1981 | Wilhelmy | |
| 4,358,130 | A | | 11/1982 | Adams | |
| 4,358,131 | A | | 11/1982 | Schwartz | |
| 4,405,150 | A | | 9/1983 | Esper | |
| 4,530,511 | A | | 7/1985 | Brandt, III | |
| 4,593,926 | A | | 6/1986 | Pergola | |
| 4,632,418 | A | | 12/1986 | Brue Moya et al. | |
| 4,635,955 | A | | 1/1987 | Zoor | |
| 4,698,039 | A | * | 10/1987 | Watson | B63B 32/20 441/77 |
| 4,723,789 | A | | 2/1988 | Schmidt | |
| 4,780,929 | A | | 11/1988 | Burns et al. | |
| 4,844,499 | A | | 7/1989 | Baumann | |
| 5,044,044 | A | * | 9/1991 | Young | A63C 5/02 16/323 |
| 5,246,401 | A | * | 9/1993 | Boatwright | A63C 5/02 280/18 |
| 5,261,689 | A | | 11/1993 | Carpenter et al. | |
| 5,618,051 | A | * | 4/1997 | Kobylenski | A63C 5/02 280/14.21 |
| 5,865,446 | A | * | 2/1999 | Kobylenski | A63C 5/02 280/14.23 |
| 5,884,933 | A | | 3/1999 | Trott | |
| 5,887,770 | A | * | 3/1999 | Covell | A45C 13/30 150/102 |
| 5,984,324 | A | * | 11/1999 | Wariakois | A63C 5/02 280/14.24 |
| 6,105,990 | A | | 8/2000 | Sutherland | |
| 6,270,091 | B1 | * | 8/2001 | Smith | A63C 5/031 280/14.21 |
| 6,616,170 | B1 | * | 9/2003 | Quarti | A63C 5/02 280/603 |
| 6,746,028 | B2 | * | 6/2004 | Barbee | B62B 15/00 280/18 |
| 6,834,867 | B2 | * | 12/2004 | Smith | A63C 5/031 280/14.21 |
| D505,470 | S | * | 5/2005 | Hong | A63C 17/12 D21/765 |
| 6,926,301 | B2 | * | 8/2005 | Emanuele | A63C 5/02 280/603 |
| 7,178,199 | B2 | | 2/2007 | Kashiwaguma | |
| 7,575,138 | B2 | | 8/2009 | Lindberg | |
| 7,681,904 | B2 | | 3/2010 | Ekberg | |
| 7,887,079 | B2 | * | 2/2011 | Krafft | A63C 5/02 280/602 |
| D633,584 | S | * | 3/2011 | Hong | A63C 17/12 D21/765 |
| 7,976,034 | B1 | * | 7/2011 | Hong | A63C 17/01 280/87.042 |
| 7,992,712 | B2 | * | 8/2011 | Rosland | D06F 89/005 206/278 |
| 8,262,157 | B2 | * | 9/2012 | Novak | A47C 1/146 297/16.2 |
| 8,459,670 | B1 | * | 6/2013 | Tizzone | A63C 17/015 280/87.042 |
| 8,469,372 | B2 | * | 6/2013 | Kloster | A63C 5/02 280/14.22 |
| 8,733,782 | B2 | * | 5/2014 | Smith | A63C 5/02 16/349 |
| 8,746,715 | B2 | * | 6/2014 | Woncik | A63C 17/0006 280/87.042 |
| 8,820,769 | B2 | * | 9/2014 | Green | A63C 5/02 280/603 |
| 8,827,286 | B2 | * | 9/2014 | Woncik | A63C 17/0006 280/87.042 |
| 9,095,766 | B1 | * | 8/2015 | Christie | A63C 17/01 |
| 9,227,131 | B2 | * | 1/2016 | Adamczewski | A63C 5/033 |
| 9,604,122 | B2 | * | 3/2017 | Kloster | A63C 5/031 |
| D790,845 | S | * | 7/2017 | Greenspon | D2/999 |
| 9,957,019 | B2 | * | 5/2018 | Sciarra | A45F 3/04 |
| 2004/0021297 | A1 | | 2/2004 | Ekberg et al. | |
| 2005/0046149 | A1 | | 3/2005 | Ekberg | |
| 2005/0167947 | A1 | | 8/2005 | Ekberg | |
| 2008/0174089 | A1 | * | 7/2008 | Ekberg | A63C 5/02 280/603 |
| 2008/0184599 | A1 | | 8/2008 | Ekberg | |
| 2008/0185817 | A1 | | 8/2008 | Gyr | |
| 2008/0246236 | A1 | * | 10/2008 | Lombano | A63C 5/02 280/18 |
| 2009/0256332 | A1 | * | 10/2009 | Ekberg | A63C 5/02 280/603 |
| 2010/0219614 | A1 | | 9/2010 | Ekberg | |
| 2015/0360756 | A1 | * | 12/2015 | Sciarra | B63B 35/7916 441/74 |
| 2017/0144735 | A1 | * | 5/2017 | Sciarra | B63B 35/7916 |
| 2017/0216709 | A1 | * | 8/2017 | Smith | A63C 5/02 |

FOREIGN PATENT DOCUMENTS

| | | | |
|---|---|---|---|
| DE | 3303093 | A1 | 8/1984 |
| DE | 100 00 581 | A1 | 8/2001 |
| WO | 2005/021112 | A2 | 3/2005 |
| WO | 2005/074518 | A2 | 8/2005 |
| WO | 2007/044846 | A2 | 4/2007 |
| WO | 2007/058719 | A2 | 5/2007 |
| WO | 2007/127969 | A2 | 11/2007 |
| WO | 2008/089486 | A2 | 7/2008 |
| WO | 2008/112936 | A1 | 9/2008 |
| WO | 2009/067716 | A1 | 5/2009 |

OTHER PUBLICATIONS

"ZigZag Backcountry Material," publication date unknown, [online], [retrieved on Oct. 5, 2011], retrieved using Internet from <http://www.zigzagtour.de/index0.html>.
International Search Report dated Feb. 28, 2012 in International Patent Application No. PCT/US2011/056389.
Office Action dated Apr. 25, 2013 in U.S. Appl. No. 13/273,902.
Office Action dated Mar. 6, 2015 in U.S. Appl. No. 14/247,912.
Written Opinion dated Feb. 28, 2012 in International Patent Application No. PCT/US2011/056389.

* cited by examiner

COLLAPSIBLE SKI HAVING FABRIC HINGE

CROSS-REFERENCE TO PRIOR APPLICATIONS

This Application claims priority of U.S. Provisional Application No. 62/288,390 filed on Jan. 28, 2016, the entire disclosure of which is hereby incorporated by reference. The entire contents of U.S. Pat. No. 8,733,782 are hereby incorporated by reference in their entirety.

BACKGROUND OF THE INVENTION

1. Field of the Invention

The present invention relates to a collapsible ski having a hinge mechanism, the ski being useful for uphill and/or cross-country travel, for example, over unpacked or partially-packed snow in the backcountry. The invention also concerns related methods and kits.

2. Related Art

Skiing and snowboarding are popular winter activities. While most winter sports enthusiasts participate in such activities within the bounds of privately-operated, lift-accessible mountain resorts, many avid skiers and snowboarders also seek access to so-called backcountry terrain. In order to access such terrain without the use of motorized vehicles such as, for example, snow machines, snow cats, and/or helicopters, specialized equipment is typically required in order to enable a skier or snowboarder to traverse cross-country and/or uphill over unpacked, partially packed, or packed snow to a point of descent.

For skiers, accessing and ascending backcountry terrain can often be achieved by slight modifications to the same equipment used for descending. For example, by utilizing specialized bindings with detachable heel pieces and a pair of detachable skins, an alpine skier can easily traverse and ascend over unpacked snow. At the point of descent, the skier can simply remove the skins, lock the heel portion of each binding, and descend. Telemark skiers may similarly attach skins to the bottom of their skis, ascend to a desired location, remove the skins, and descend.

Snowboarders, on the other hand, typically require additional and/or highly modified equipment to access such terrain without significantly increasing the amount and weight of equipment required. For example, snowboarders have been known to utilize split snowboards, various types of modern snowshoes, or so-called "short skis" to traverse and ascend in the backcountry. These solutions, however, have disadvantages. A split snowboard, for example, is essentially a snowboard constructed in two pieces and separable along the longitudinal axis thereof into two distinct "skis" separately attachable to the user's respective boots for ascending and traversing. To descend, the distinct pieces are then coupled together by the user along mating longitudinal edges with known locking/latching mechanisms to form a snowboard. Accordingly, while allowing for both ascending and descending, split boards do not have the same stability and feel as a modern (one-piece) freestyle snowboard when ridden downhill due to the inherent center seam and the resulting play introduced by the large number of locking/mating parts. Moreover, split boards are typically heavy and cumbersome and provide compromised feel and long transition time. Additionally, they can be relatively expensive. Snowshoes also have disadvantages in that they make travel comparably inefficient and slow and do not allow the backcountry snowboarder to take advantage of tracking along packed ski tracks created by, for example, skiers. Likewise, short skis with releasable bindings and removable skins are still similarly inefficient and ineffective as they are both too long to fit in a backpack and not long enough for climbing and traversing through and over unpacked terrain.

What is needed is an effective, lightweight backcountry access tool for snowboarders and/or other outdoor enthusiasts or military that is easily stowable (such as in a backpack) and thereby avoids the foregoing disadvantages. Additionally, a hinge mechanism and/or binding suitable for this and other applications is needed.

SUMMARY OF THE INVENTION

An embodiment of the invention relates to a collapsible ski device, having: a first forward ski member having a bottom surface, a tip and a rear end; a second middle ski member having a bottom surface, a forward end and a rear end; and a third rear ski member having a bottom surface, a forward end and a tail. In such an embodiment, the forward end of the second middle ski member is pivotably coupled to the rear end of the first forward ski member by a first hinge mechanism. The first hinge mechanism has a flexible component attached at a first location to a first attachment surface on the first forward ski member and attached at a second location to a second attachment surface on the second middle ski member. The rear end of the second middle ski member is pivotably coupled to the forward end of the third rear ski member by a second hinge mechanism. The second hinge mechanism having a flexible component attached at a first location to a third attachment surface on the second middle ski member and attached at a second location to a fourth attachment surface on the third rear ski member.

An embodiment of the invention relates to a kit for accessing and ascending snow-covered back-country terrain, having a pair of the collapsible ski devices above.

An embodiment of the invention relates to a method of making a collapsible ski device, including the steps of: providing a first forward ski member, a second middle ski member, and a third rear ski member; pivotably coupling a rear end of the first forward ski member to a forward end of the second middle ski member by a first hinge mechanism; and pivtoably coupling a rear end of the second middle ski member to a forward end of the third rear ski member by a second hinge mechanism. In such an embodiment, the first hinge mechanism has a flexible component attached at a first location to a first attachment surface on the first forward ski member and attached at a second location to a second attachment surface on the second middle ski member. The second hinge mechanism has a flexible component attached at a first location to a third attachment surface on the second middle ski member and attached at a second location to a fourth attachment surface on the third rear ski member.

DESCRIPTION OF THE FIGURES

Exemplary embodiments of the invention will be now described in greater detail below with reference to the accompanying drawings, in which.

DETAILED DESCRIPTION OF THE INVENTION

Figure 1:
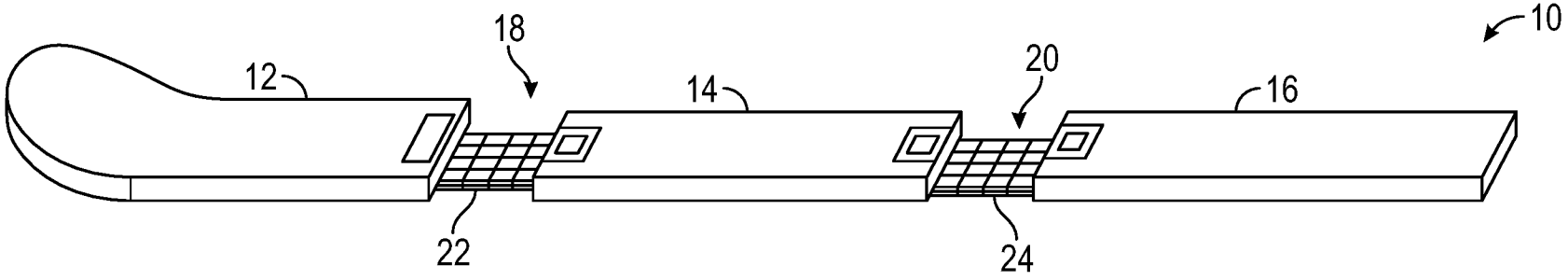
FIG. 1 is an exploded view of a collapsible ski device in an extended position according to an embodiment of the invention.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide example.

An embodiment of the invention relates to a collapsible ski device, having: a first forward ski member having a bottom surface, a tip and a rear end; a second middle ski member having a bottom surface, a forward end and a rear end; and a third rear ski member having a bottom surface, a forward end and a tail. In such an embodiment, the forward end of the second middle ski member is pivotably coupled to the rear end of the first forward ski member by a first hinge mechanism. The first hinge mechanism has a flexible component attached at a first location to a first attachment surface on the first forward ski member and attached at a second location to a second attachment surface on the second middle ski member. The rear end of the second middle ski member is pivotably coupled to the forward end of the third rear ski member by a second hinge mechanism. The second hinge mechanism having a flexible component attached at a first location to a third attachment surface on the second middle ski member and attached at a second location to a fourth attachment surface on the third rear ski member.

Some embodiments of the invention relate to the ski device above, where the ski device is configured to be collapsed from an extended position to a folded position.

Some embodiments of the invention relate to the ski device above, where the flexible component is a fabric such as, for example, a woven fabric.

Some embodiments of the invention relate to the ski device above, where the first attachment surface is disposed on a location on the bottom surface of the first forward ski member. In such embodiments, the second attachment surface is disposed on a first location on the bottom surface of the second middle ski member, the third attachment surface is disposed on a second location on the bottom surface of the second middle ski member, and the fourth attachment surface is disposed on a location on the bottom surface of the third rear ski member.

Some embodiments of the invention relate to the ski device above, where the first hinge mechanism further has a first support mechanism. In such embodiments, the second hinge mechanism further has a second support mechanism.

Some embodiments of the invention relate to the ski device above, where the first support mechanism has a first hinge limitation contact surface disposed on the rear end of the first forward ski member and a second hinge limitation contact surface disposed on the forward end of the second middle ski member. In such embodiments, the second support mechanism has a third hinge limitation contact surface disposed on the rear end of the second middle ski member and a fourth hinge limitation contact surface disposed on the forward end of the third rear ski member. The first hinge limitation contact surface and the second hinge limitation contact surface are configured to contact one another when the first hinge mechanism is in an extended position. The third hinge limitation contact surface and the fourth hinge limitation contact surface are configured to contact one another when the second hinge mechanism is in an extended position.

Some embodiments of the invention relate to the ski device above, where an angle between the bottom surfaces of adjacent ski members is less than 180 degrees when the collapsible ski device is in the extended position.

Some embodiments of the invention relate to the ski device above, where the bottom surfaces of the adjacent ski members define a facted camber.

Some embodiments of the invention relate to the ski device above, further having a strip of climbing material secured to the bottom surface of each of the first forward ski member, the second middle ski member and the third rear ski member.

Some embodiments of the invention relate to the ski device above, further having a boot binding coupled to the second middle ski member.

An embodiment of the invention relates to a kit for accessing and ascending snow-covered back-country terrain, having a pair of the collapsible ski devices above.

Some embodiments of the invention relate to the kit above, further having a backpack configured to receive and stow the ski devices when the ski devices are in a folded position.

An embodiment of the invention relates to a method of making a collapsible ski device, including the steps of: providing a first forward ski member, a second middle ski member, and a third rear ski member; pivotably coupling a rear end of the first forward ski member to a forward end of the second middle ski member by a first hinge mechanism; and pivtoably coupling a rear end of the second middle ski member to a forward end of the third rear ski member by a second hinge mechanism. In such an embodiment, the first hinge mechanism has a flexible component attached at a first location to a first attachment surface on the first forward ski member and attached at a second location to a second attachment surface on the second middle ski member. The second hinge mechanism has a flexible component attached at a first location to a third attachment surface on the second middle ski member and attached at a second location to a fourth attachment surface on the third rear ski member.

Some embodiments of the invention relate to the method above, where the flexible component is a fabric, such as, for example, a woven fabric.

Some embodiments of the invention relate to the method above, where the first attachment surface is disposed on a location on a bottom surface of the first forward ski member, the second attachment surface is disposed on a first location on a bottom surface of the second middle ski member, the third attachment surface is disposed on a second location on the bottom surface of the second middle ski member, and the fourth attachment surface is disposed on a location on a bottom surface of the third rear ski member.

Some embodiments of the invention relate to the method above, where the first hinge mechanism also has a first support mechanism, and the second hinge mechanism also has a second support mechanism.

Some embodiments of the invention relate to the method above, where the first support mechanism has a first hinge limitation contact surface disposed on the rear end of the first forward ski member and a second hinge limitation contact surface disposed on the forward end of the second middle ski member, the second support mechanism includes a third hinge limitation contact surface disposed on the rear end of the second middle ski member and a fourth hinge limitation contact surface disposed on the forward end of the third rear ski member. In such embodiments, the first hinge limitation contact surface and the second hinge limitation contact surface are configured to contact one another when the first hinge mechanism is in an extended position and the third hinge limitation contact surface and the fourth hinge limitation contact surface are configured to contact one another when the second hinge mechanism is in an extended position.

Some embodiments of the invention relate to the method above, also including attaching a strip of climbing skin to a bottom surface of each of the ski members.

Some embodiments of the invention relate to the method above, also including coupling a boot binding to the second middle ski member.

Some embodiments of the invention relate to the ski device above, further having a boot binding coupled to the second middle ski member. Methods of coupling a boot binding to a ski surface are understood in the art. Some such methods are discussed in U.S. Pat. No. 8,733,782, which is hereby incorporated by reference.

FIG. 1 is an exploded view of a collapsible ski device 10 in an extended position according to an embodiment of the invention. The collapsible ski device has: a first forward ski member 12 having a bottom surface, a tip and a rear end; a second middle ski member 14 having a bottom surface, a forward end and a rear end; and a third rear ski member 16 having a bottom surface, a forward end and a tail. The forward end of the second middle ski member 14 is pivotably coupled to the rear end of the first forward ski member 12 by a first hinge mechanism 18. The first hinge mechanism has a flexible component 22 attached at a first location to a first attachment surface on the first forward ski member and attached at a second location to a second attachment surface on the second middle ski member. The rear end of the second middle ski member 14 is pivotably coupled to the forward end of the third rear ski member 16 by a second hinge mechanism 20. The second hinge mechanism has a flexible component 24 attached at a first location to a third attachment surface on the second middle ski member and attached at a second location to a fourth attachment surface on the third rear ski member. As will be described in more detail below, the first hinge mechanism 18 and/or the second hinge mechanism 20 can comprise a fabric or other flexible material.

Figure 2:
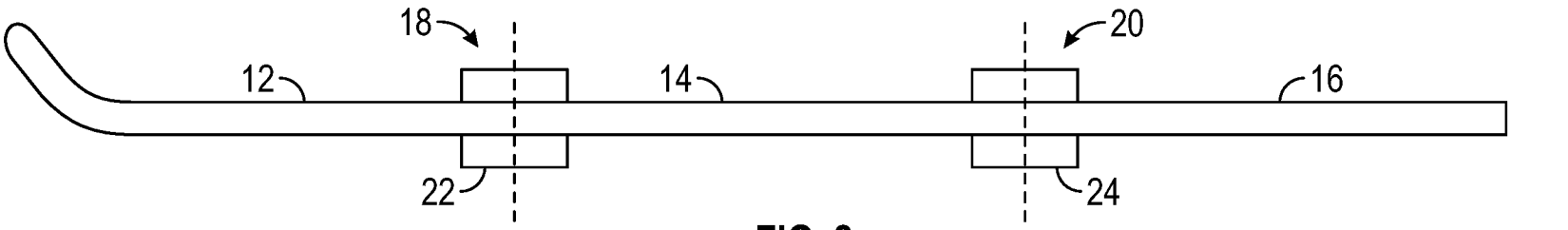
FIG. 2 is a side view of the collapsible ski device of FIG. 1.

FIG. 2 is a side view of the collapsible ski device of FIG. 1.

Figure 3:
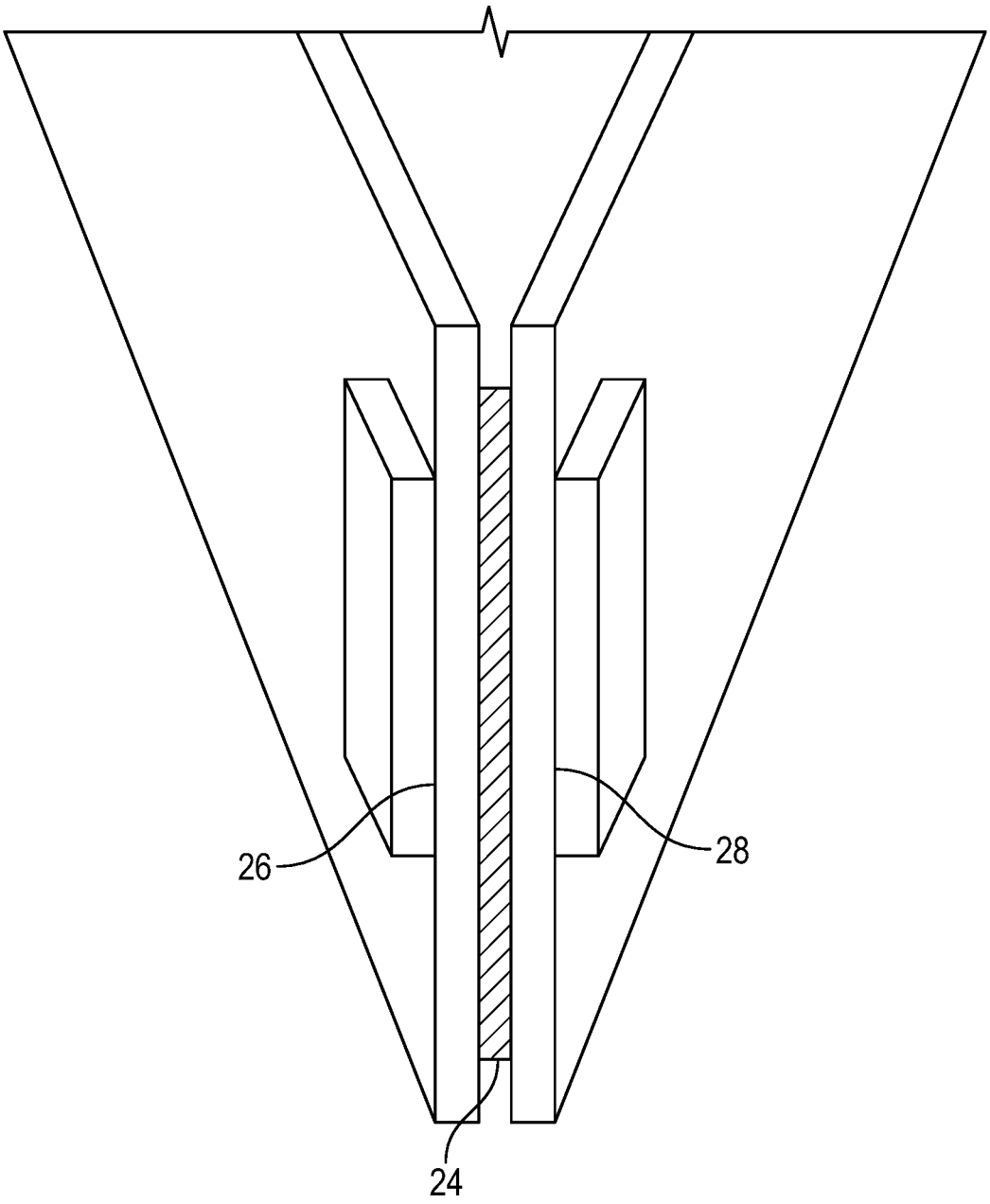
FIG. 3 is a view of one of the hinge mechanisms of the collapsible ski device of FIG. 1 in a folded position.

FIG. 3 is a view of one of the hinge mechanisms of the collapsible ski device of FIG. 1 in a folded position. The hinge mechanism 18, 20 includes a support mechanism which includes a hinge limitation contact surface 26 disposed on the rear end of the first forward ski member and/or the rear end of the second middle ski member, and another hinge limitation contact surface 28 disposed on the forward end of the second middle ski member and/or the forward end of the third rear ski member. The adjacent ski members are joined by a flexible component 24. The hinge limitation contact surfaces are configured to contact one another when the hinge mechanism is in an extended position (e.g. when the first forward ski member 12 is aligned with the second middle ski member 14 and/or when the third rear ski member 16 is aligned with the second middle ski member 14. The hinge limitation contact surfaces prevents the adjacent ski members from collapsing when the ski is in use. These hinge limitation contact surfaces can be understood to act as stop elements for the hinge mechanism when in an extended position.

Figure 4:
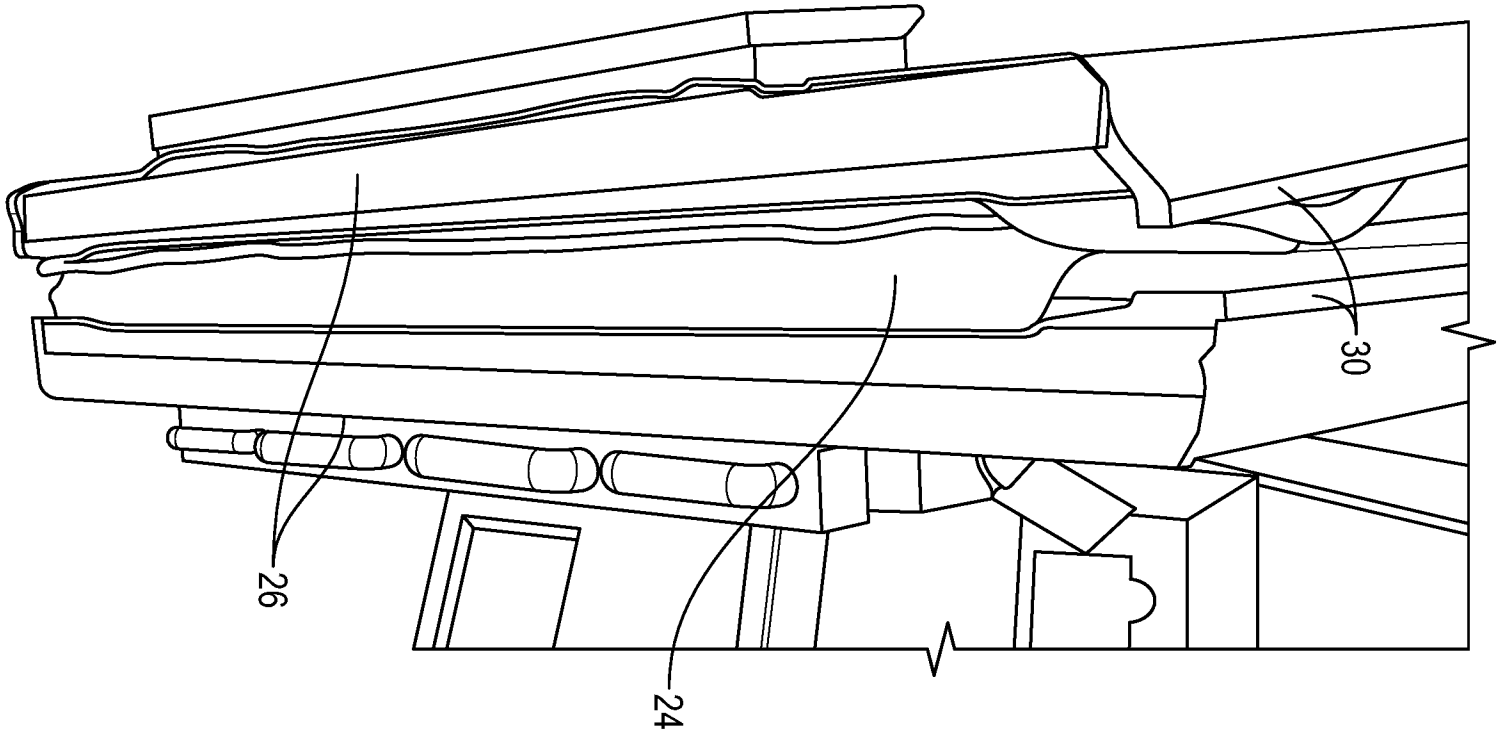
FIG. 4 is a view of a hinge mechanism of a collapsible ski device in a folded position according to an embodiment of the invention.

FIG. 4 is a view of a hinge mechanism of a collapsible ski device in a folded position according to an embodiment of the invention. The collapsible ski device has steel edges 30 on the underside, a flexible hinging fabric connection 24, and adjacent ski member limitation contact surfaces 26.

Figure 5:
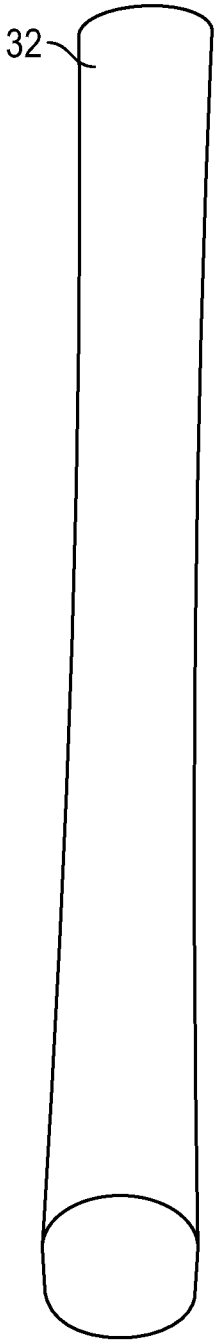
FIG. 5 shows the continuous body surface of a collapsible ski device when in an extended position according to an embodiment of the invention.

FIG. 5 is a bottom view of the continuous body surface 32 of a collapsible ski device when in an extended position according to an embodiment of the invention.

Figure 6:
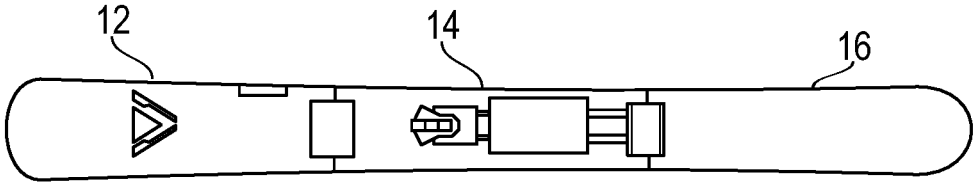
FIG. 6 shows an alternative view of the collapsible ski device of FIG. 5.

FIG. 6 shows an alternative view of the collapsible ski device of FIG. 5. The three adjacent ski members 12, 14, 16 are shown in an extended position.

Figure 7:
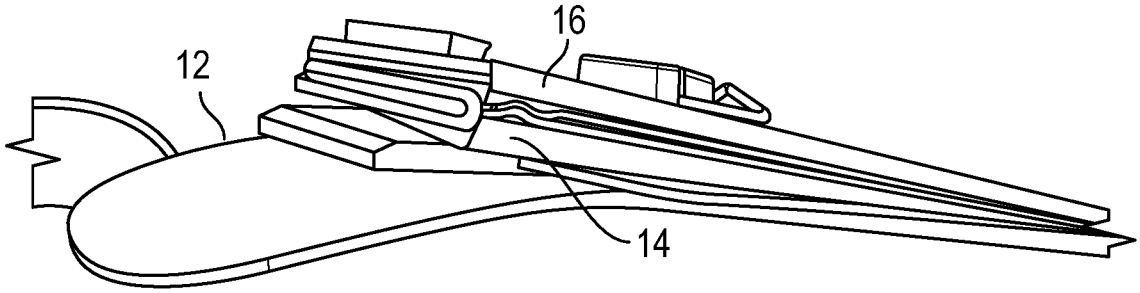
FIG. 7 shows a collapsible ski device in a folded position according to an embodiment of the invention.

FIG. 7 shows a collapsible ski device in a folded position according to an embodiment of the invention. The three adjacent ski members 12, 14, 16 are shown in a folded position.

Figure 8:
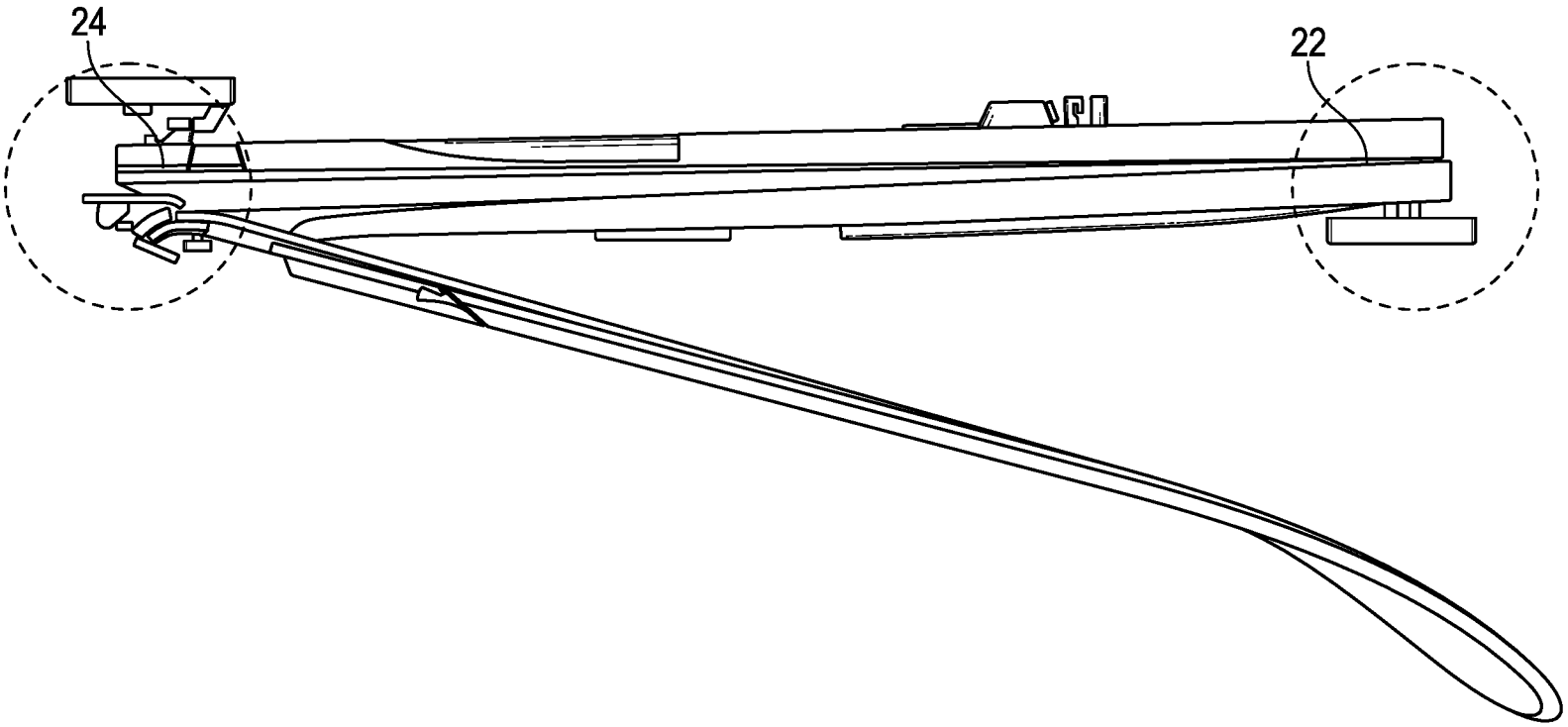
FIG. 8 shows an alternative view of the folded ski device of FIG. 7.

FIG. 8 shows an alternative view of the folded ski device of FIG. 7. The adjacent ski members are joined by a flexible fabric 22, 24. The flexible fabric 22, 24 can extend from the bottom of one ski member to another.

Figure 9:
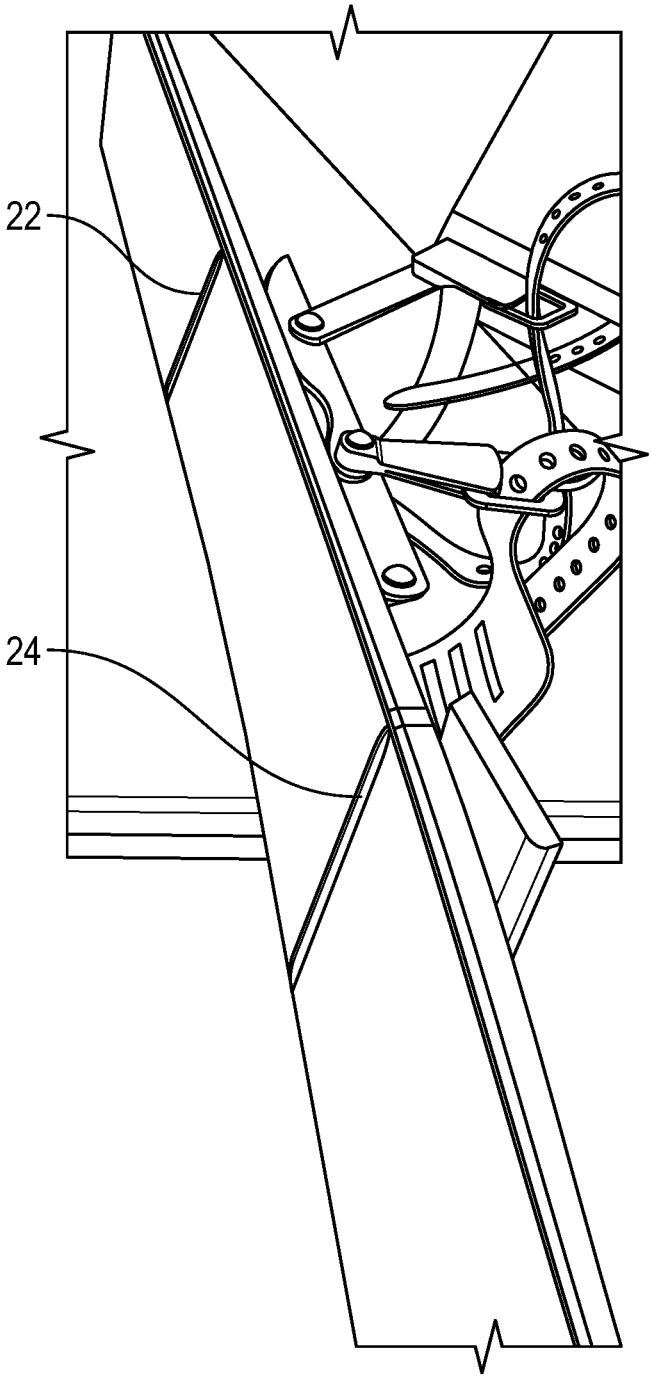
FIG. 9 shows a collapsible ski device in an extended position with a boot binding according to an embodiment of the invention.

FIG. 9 shows a collapsible ski device in an extended position with a boot binding according to an embodiment of the invention. The adjacent ski members are joined by a flexible fabric 22, 24.

Figure 10:
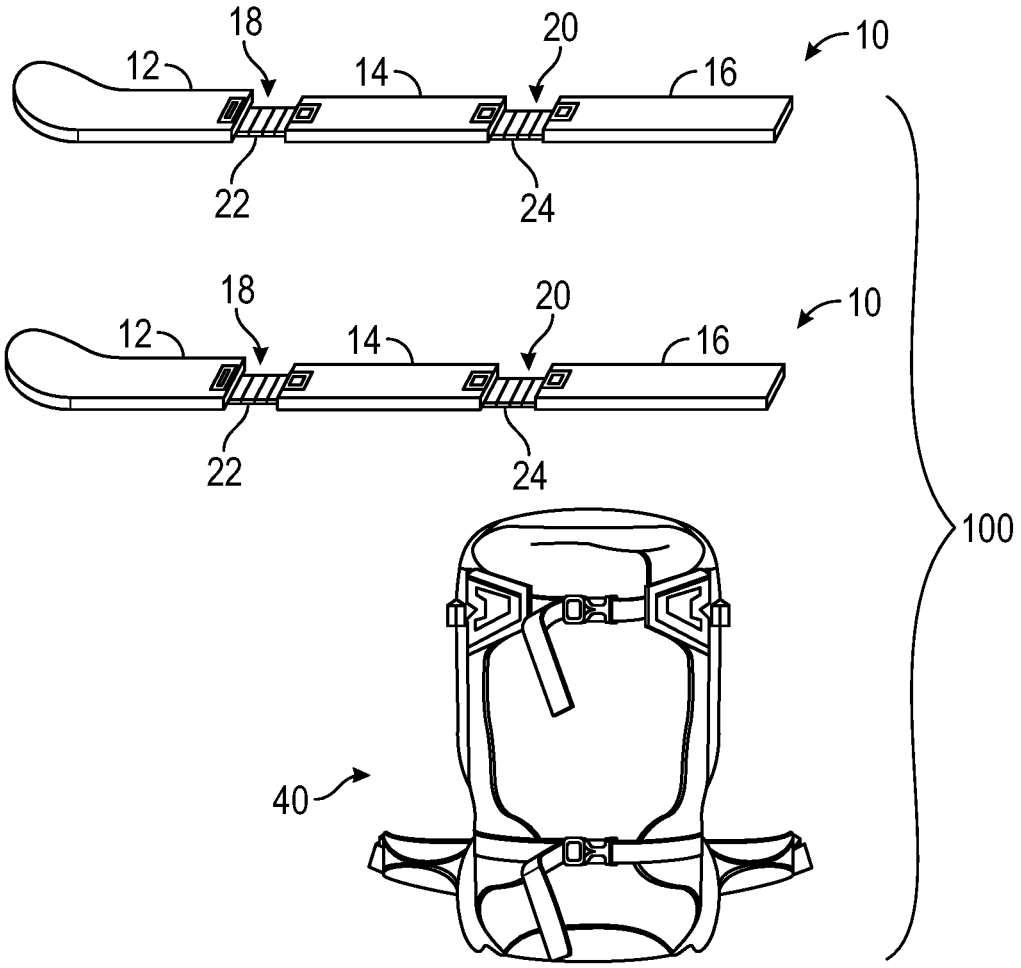
FIG. 10 shows a kit for accessing and ascending snow-covered back-country terrain, having a pair of collapsible ski devices according to an embodiment of the invention.

FIG. 10 shows a kit 100 for accessing and ascending snow-covered back-country terrain, having a pair of collapsible ski devices 10 and a backpack 40 for carrying the ski devices when they are in a folded position.

Some embodiments of the invention relate to a ski for use in overland travel having: separate parts making up a single ski (e.g., 2, or 3 parts). Each section of ski can have an underside and edges 30 (FIG. 4). In some embodiments, these edges are made of steel. In some embodiments, adjoining ends are designed to fit together 22 (FIG. 9). Some embodiments include a hinging fabric 24 located between the adjoining ends 30 for joining them together rigidly in a position that is both aligned and co-planar with the ski (FIG. 4). A view of the ski in an extended position is shown in FIG. 5 and FIG. 6. The hinge allows for the two parts of the ski to fold under (without becoming completely detached) in a folded position (FIG. 7), underside against underside (FIG. 8). As shown in FIG. 9, some embodiments include a flexible fabric connector 24 for stabilizing the two parts of the ski in the aligned position. Aligned and coplanar, adjoining ends match and fit together 22 (FIG. 9).

Some embodiments of the invention include a flexible component which is made of a woven fabric that connects multiple segments that make up a ski when un-folded.

In some embodiments, the fabric is attached to the ski segments on the bottom (underside) of the ski segments, on the top of the ski segments, or is located somewhere in between (e.g., sandwiched within the laminated layers of each ski segment).

In some embodiments, the fabric comprises one piece that extends along the bottom of the first, second, and third ski segments.

In some embodiments, the fabric is attached to the ski segments by bonding (e.g. via the use of adhesives), fasteners (e.g. staples, screws, buckles, etc.) or combinations thereof.

One of ordinary skill in the art would recognize from this disclosure the types of methods and fibers that are used to create flexible fabrics to adjoin the ski segments. In some embodiments, the woven fabrics are made of durable fibers that are made up of natural materials (such as cotton, linen, wool, silk, cashmere, hemp, jute or blends thereof), synthetic materials (such as synthetic polymers), or combinations thereof.

Some embodiments of the invention include a segmented ski with flexible fabric connections that act as hinges so the ski can fold.

Some embodiments of the invention include a flexible component which is made of a woven fabric that connects multiple segments that make up a ski. To achieve rigidity when a person walks on the apparatus, the support mechanism, which is formed by a flexible fabric, maintains its form and length, creating a contact point (or pinch) in the ends of the ski segments above said fabric. That contact point between the segments (pinch) prevents the ski from collapsing when a person stands on it.

The fabric hinged ski can be made of segments. The first segment has a hinge attachment surface, a second ski segment with a hinge attachment surface, and a fabric hinge member. The fabric hinge member is secured to the hinge attachment surfaces of the first and the second segments whereby at least some of the fibers of the fabric hinge member are embedded within the hinge attachment surfaces of the first and the second members.

The flexible hinged ski may consist of a molded flexible hinge section (FIG. 4), a hinge attachment surface, and a hinge limitation contact section 26 (FIG. 4). The molded flexible hinge section (FIG. 4) provides a flexible and reliable member allowing the segments to be folded approximately 180 degrees in one direction only. The contact section 26 ensures that the segments remain in a straight and solid configuration during use.

In some embodiments, the various binding and locking mechanisms described in U.S. Pat. No. 8,733,782 are coupled to the collapsible ski device described above.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiments can be configured without departing from the scope of the invention. The illustrated embodiments have been set forth only for the purposes of example and should not be taken as limiting the invention. Therefore, it is to be understood that, within the scope of the appended claims, the invention may be practiced other than as specifically described herein.

We claim:

1. A collapsible ski device, comprising:

a first forward ski member having a bottom surface, a tip and a rear end;

a second middle ski member having a bottom surface, a forward end and a rear end; and a third rear ski member having a bottom surface, a forward end and a tail, wherein the forward end of the second middle ski member is pivotably coupled to the rear end of the first forward ski member by a first hinge mechanism, the first hinge mechanism comprising a flexible component attached at a first location to a first attachment surface on the first forward ski member and attached at a second location to a second attachment surface on the second middle ski member, wherein the rear end of the second middle ski member is pivotably coupled to the forward end of the third rear ski member by a second hinge mechanism, the second hinge mechanism comprising a flexible component attached at a first location to a third attachment surface on the second middle ski member and attached at a second location to a fourth attachment surface on the third rear ski member, wherein the flexible component of the first hinge mechanism and the second hinge mechanism is a woven fabric, and further comprising a strip of climbing material configured to be secured to the bottom surface of each of the first forward ski member, the second middle ski member and the third rear ski member.

2. The collapsible ski device of claim 1, wherein the ski device is configured to be collapsed from an extended position to a folded position.

3. The collapsible ski device of claim 1, wherein the first attachment surface is disposed on a location on the bottom surface of the first forward ski member, wherein the second attachment surface is disposed on a first location on the bottom surface of the second middle ski member, wherein the third attachment surface is disposed on a second location on the bottom surface of the second middle ski member, and wherein the fourth attachment surface is disposed on a location on the bottom surface of the third rear ski member.

4. The collapsible ski device of claim 1, wherein the first hinge mechanism further comprises a first support mechanism, and wherein the second hinge mechanism further comprises a second support mechanism.

5. The collapsible ski device of claim 4, wherein the first support mechanism comprises a first hinge limitation contact surface disposed on the rear end of the first forward ski member and a second hinge limitation contact surface disposed on the forward end of the second middle ski member, wherein the second support mechanism comprises a third hinge limitation contact surface disposed on the rear end of the second middle ski member and a fourth hinge limitation contact surface disposed on the forward end of the third rear ski member, wherein the first hinge limitation contact surface and the second hinge limitation contact surface are configured to contact one another when the first hinge mechanism is in an extended position, and wherein the third hinge limitation contact surface and the fourth hinge limitation contact surface are configured to contact one another when the second hinge mechanism is in an extended position.

6. The collapsible ski device of claim 1, wherein an angle between the bottom surfaces of adjacent ski members is less than 180 degrees when the collapsible ski device is in an extended position.

7. The collapsible ski device of claim 1, wherein the bottom surfaces of the adjacent ski members define a faceted camber.

8. The collapsible ski device of claim 1, further comprising a boot binding coupled to the second middle ski member.

9. A kit for accessing and ascending snow-covered backcountry terrain, comprising a pair of the collapsible ski devices of claim 1.

10. The kit of claim 9, further comprising a backpack configured to receive and stow the ski devices when the ski devices are in a folded position.

11. A method of making a collapsible ski device, comprising:

providing a first forward ski member, a second middle ski member, and a third rear ski member;

pivotably coupling a rear end of the first forward ski member to a forward end of the second middle ski member by a first hinge mechanism; and pivotably coupling a rear end of the second middle ski member to a forward end of the third rear ski member by a second hinge mechanism, wherein the first hinge mechanism comprises a flexible component attached at a first location to a first attachment surface on the first forward ski member and attached at a second location to a second attachment surface on the second middle ski member, wherein the second hinge mechanism comprises a flexible component attached at a first location to a third attachment surface on the second middle ski member and attached at a second location to a fourth attachment surface on the third rear ski member, wherein the flexible component of the first hinge mechanism and the second hinge mechanism is a woven fabric, and further comprising attaching a strip of climbing skin to a bottom surface of each of the ski members.

12. The method of claim 11, wherein the first attachment surface is disposed on a location on a bottom surface of the first forward ski member, wherein the second attachment surface is disposed on a first location on a bottom surface of the second middle ski member, wherein the third attachment surface is disposed on a second location on the bottom surface of the second middle ski member, and wherein the fourth attachment surface is disposed on a location on a bottom surface of the third rear ski member.

13. The method of claim 11, wherein the first hinge mechanism further comprises a first support mechanism, and wherein the second hinge mechanism further comprises a second support mechanism.

14. The method of claim 13, wherein the first support mechanism comprises a first hinge limitation contact surface disposed on the rear end of the first forward ski member and a second hinge limitation contact surface disposed on the forward end of the second middle ski member, wherein the second support mechanism comprises a third hinge limitation contact surface disposed on the rear end of the second middle ski member and a fourth hinge limitation contact surface disposed on the forward end of the third rear ski member, wherein the first hinge limitation contact surface and the second hinge limitation contact surface are configured to contact one another when the first hinge mechanism is in an extended position, and wherein the third hinge limitation contact surface and the fourth hinge limitation contact surface are configured to contact one another when the second hinge mechanism is in an extended position.

15. The method of claim 11, further comprising coupling a boot binding to the second middle ski member.

16. A collapsible ski device, comprising:

a first forward ski member having a bottom surface, a tip and a rear end;

a second middle ski member having a bottom surface, a forward end and a rear end; and a third rear ski member having a bottom surface, a forward end and a tail, wherein the forward end of the second middle ski member is pivotably coupled to the rear end of the first forward ski member by a first hinge mechanism, the first hinge mechanism comprising a flexible component attached at a first location to a first attachment surface on the first forward ski member and attached at a second location to a second attachment surface on the second middle ski member, wherein the rear end of the second middle ski member is pivotably coupled to the forward end of the third rear ski member by a second hinge mechanism, the second hinge mechanism comprising a flexible component attached at a first location to a third attachment surface on the second middle ski member and attached at a second location to a fourth attachment surface on the third rear ski member, wherein the flexible component of the first hinge mechanism and the second hinge mechanism is a woven fabric, and wherein the woven fabric of the flexible component of the first hinge mechanism and the second hinge mechanism is not part of a climbing skin.

17. A method of making a collapsible ski device, comprising:

providing a first forward ski member, a second middle ski member, and a third rear ski member;

pivotably coupling a rear end of the first forward ski member to a forward end of the second middle ski member by a first hinge mechanism; and pivotably coupling a rear end of the second middle ski member to a forward end of the third rear ski member by a second hinge mechanism, wherein the first hinge mechanism comprises a flexible component attached at a first location to a first attachment surface on the first forward ski member and attached at a second location to a second attachment surface on the second middle ski member, wherein the second hinge mechanism comprises a flexible component attached at a first location to a third attachment surface on the second middle ski member and attached at a second location to a fourth attachment surface on the third rear ski member, wherein the flexible component of the first hinge mechanism and the second hinge mechanism is a woven fabric, and wherein the woven fabric of the flexible component of the first hinge mechanism and the second hinge mechanism is not part of a climbing skin.

* * * * *